US007016620B2

(12) United States Patent
Maess et al.

(10) Patent No.: US 7,016,620 B2
(45) Date of Patent: Mar. 21, 2006

(54) METHOD AND DEVICE FOR CONTROLLING A PRINT PROCESS WITH HIGH COLOR DENSITY

(75) Inventors: Volkhard Maess, Erding (DE); Hans Winter, München (DE); Christian Scholz, Stockdorf (DE)

(73) Assignee: Oce Printing Systems GmbH, Poing (DE)

( * ) Notice: Subject to any disclaimer, the term of this patent is extended or adjusted under 35 U.S.C. 154(b) by 38 days.

(21) Appl. No.: 10/486,372

(22) PCT Filed: Jul. 24, 2002

(86) PCT No.: PCT/EP02/08260

§ 371 (c)(1),
(2), (4) Date: Jun. 24, 2004

(87) PCT Pub. No.: WO03/012553

PCT Pub. Date: Feb. 13, 2003

(65) Prior Publication Data

US 2004/0234285 A1 Nov. 25, 2004

(30) Foreign Application Priority Data

Jul. 25, 2001 (DE) ..... 101 36 259

(51) Int. Cl.
*G03G 15/043* (2006.01)

(52) U.S. Cl. ..... 399/51; 399/49; 399/60

(58) Field of Classification Search ..... 399/49, 399/51, 58, 72, 60, 62, 63, 64
See application file for complete search history.

(56) References Cited

U.S. PATENT DOCUMENTS

| | | | | |
|---|---|---|---|---|
| 4,962,407 | A * | 10/1990 | Ueda | 335/208 |
| 5,351,107 | A * | 9/1994 | Nakane et al. | 399/49 |
| 5,486,901 | A * | 1/1996 | Fukuchi et al. | 399/40 |
| 5,625,766 | A | 4/1997 | Kauffman | |
| 5,822,079 | A * | 10/1998 | Okuno et al. | 358/300 |
| 5,895,141 | A * | 4/1999 | Budnik et al. | 399/58 |
| 6,385,408 | B1 * | 5/2002 | Scheuer | 399/49 |

FOREIGN PATENT DOCUMENTS

| | | |
|---|---|---|
| DE | 39 38 354 | 5/1990 |
| DE | 41 26 457 | 2/1992 |
| DE | 41 26 446 | 8/1992 |
| DE | 199 00 164 | 7/2000 |
| JP | 06003931 A * | 1/1994 |
| WO | WO 99/36834 | 7/1999 |

* cited by examiner

*Primary Examiner*—Robert Beatty
(74) *Attorney, Agent, or Firm*—Schiff Hardin LLP

(57) ABSTRACT

In a method and device to control a print process in a printer or copier, with a character generator generating a latent print image and a latent toner marking on an image carrier. An exposure energy per unit area for the generation of the latent toner marking is decreased in comparison to an energy per unit area for generation of the latent print image. The latent print image and the latent toner marking are developed with toner in the developer station. An optical reflection sensor determines color density of the developed toner marking. Toner concentration is adjusted in a developer station dependent on a signal of the reflection sensor.

27 Claims, 3 Drawing Sheets

METHOD AND DEVICE FOR CONTROLLING A PRINT PROCESS WITH HIGH COLOR DENSITY

BACKGROUND

The invention concerns a method to control the print process in a printer or copier in which a character generator generates a latent print image and a latent toner marking on an intermediate carrier. Furthermore, the invention concerns a device to implement the method.

To generate the printed image in electrographically operating printers or copiers, toner material is applied and fixed to a carrier material, for example paper, corresponding to the image structure. Examples for such print processes are the electrophotographic method and the magneto-electric method. Here, a latent print image is initially generated on an intermediate carrier (for example on a photoconductor), this latent print image is inked, and subsequently is transferred to the carrier. To achieve a high print quality, the inking of the print image must be kept within narrow predetermined limits. Such a print image can comprise whole surfaces, rastered semi-tone surfaces, lines, characters and other relatively complex image elements. For precise control of the print process, the inking degree for the print image is indirectly determined using a toner marking, and the print process is controlled or regulated dependent on the print result given this toner marking. Therefore, a latent toner marking is generated on the intermediate carrier in addition to the latent image important to the client. Such a toner marking is relatively small compared to the surface of the print image.

Given high color densities or inking degrees, a high concentration of the colorant is necessary, meaning the associated toner marking is relatively dark. Given the scanning of such a dark toner marking by an optical reflection sensor, its sensitivity is reduced, meaning the characteristic line of the color density on the toner marking over the toner concentration runs relatively flat. This has the result that, given high color densities, the adjustment of the precise toner concentration is difficult. This effect is further amplified in that small surfaces are inked darker than large surfaces, meaning the relatively small toner marks are inked darker than the larger surface elements of the print image.

DE-A-39 38 354 specifies a method to control the print process in an image generation device. Given the generation of a latent toner marking, the energy is lowered in comparison to the energy for the generation of a latent print image. A reflection sensor determines the color density of the inked toner marking. Dependent on this signal of this reflection sensor, either the lamp voltage of the character generator, the bias voltage for a development process, or the grid voltage of the main charger is adjusted. The influencing of the toner concentration in the development station is not specified.

The document WO 99/36834 by the same applicant specifies the scanning of toner marks with the aid of a reflex sensor. Dependent on the measurement result of the reflex sensor, the toner concentration in the developer station is adjusted.

The document DE-A-199 00 164 by the same applicant specifies the measurement of the toner density of a toner marking. The toner concentration is adjusted dependent on the measured value.

The document U.S. Pat. No. 4,962,407 specifies an electrophotographic copier device, whereby measurement signals of two reference markings of different color density are used to determine the toner concentration. The toner concentration is inferred from the difference signal for both toner markings, and given deviation from a desired value the toner concentration is corrected in the developer station.

The documents DE-A-41 26 446 and DE-A-41 26 457 specify a developing unit to develop color toner images, in that image patterns that were generated with the aid of two different potentials are scanned. Using the measurement signals, the toner concentration can then be inferred, and these can be updated.

SUMMARY

It is an object to specify a method and a device to control the print process, in that, given high toner density, the toner concentration can also be adjusted with high precision.

This object is achieved by a method to control a print process in a printer or copier. With a character generator, generating a latent print image and a latent toner marking on an image carrier. An exposure energy per unit area for the generation of the latent toner marking is decreased in comparison to an energy per unit area for generation of the latent print image given an otherwise identical image structure. The latent print image and the latent toner marking are developed with toner in a developer station. An optical reflection sensor determines color density of the developed toner marking. Toner concentration is adjusted in the developer station dependent on a signal of the reflection sensor.

An exemplary embodiment is explained in the following using the drawings.

DESCRIPTION OF THE PREFERRED EMBODIMENT

Figure 1:
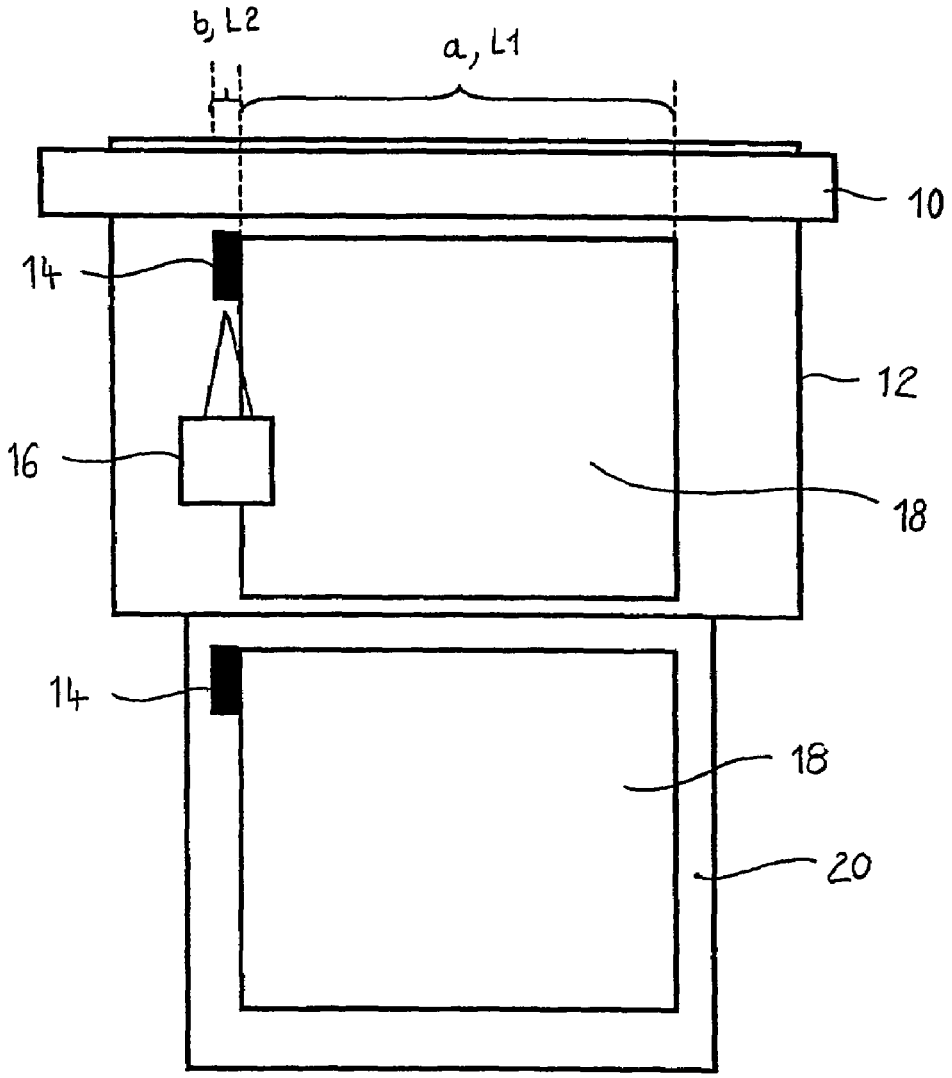
FIG. 1 illustrates schematically, the assembly of important functional elements in an electrophotographic printer.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

With the preferred embodiment, the energy per area unit for the generation of the latent toner marking is lowered in comparison to the energy per unit area for the generation of the latent print image, given the otherwise identical image structure. In electrophotographic print processes, for example, this energy exists in the form of radiant energy. This means that, in electrophotographic processes, this radiant energy for the generation of the latent toner marking (which, for example, can be designed as a completely toner developed area) is lowered in comparison to the radiant energy of an area completely developed by toner of the latent print image. Consequently the color density of the area completely developed by toner of the toner marking is lower than the color density in the corresponding print image. Accordingly, the signal of the reflection sensor that scans the toner marking is stronger; moreover, the operating point of the reflection sensor lies at a steeper range on a characteristic function line of the color density versus the toner concentration. A change of the color density on the toner marking accordingly effects a correspondingly larger change of the signal of the reflection sensor, whereby the toner concentration can be controlled with a higher precision in order to achieve the desired color density on the printed print image.

According to a further aspect of the preferred embodiment, a device is specified, effects of which are already specified in connection with the method.

FIG. 1 shows schematically the assembly of important components of a device to control an electrophotographic print process. A character generator 10 is designed in the form of a LED comb. It comprises a plurality of LEDs whose light is emitted to the surface of a photoconductor drum 12 in order to generate latent image structures there in the form of a charge image. In region a, the character generator 10 emits light with the luminous power L1. This region a is a region in which print images are generated for the client. In an track arranged adjacent thereto with the region b, the LEDs of the character generator 10 emit light to generate the structure of the toner marking 14. However, this light has a lower luminous power L2 than the luminous power L1 in the region a for a same image structure (in the present case a whole-tone image structure). The marking 14 inked with toner (the process step of the development with toner was omitted in FIG. 1 for reasons of clarity) is scanned on the photoconductor 12 by a reflection sensor 16. Its electrical signal is utilized to control or regulate the print process, as is further explained in detail below.

In a later process step, the print image 18 inked with toner is transferred to a paper web 20. The toner marking 14 is not comprised in the print image 18 for the client.

In order to print the print image for the client with the desired color density or the desired inking degree, a basic setting and further steps are effected:

Step a: The print image desired by the client is printed with a color density adjustable at the printer.

Step b: With the aid of a densitometer, the color density in the print image of the client is measured. This color density is a logarithmic measure of the relationship from the reflection degree of the background to the reflection degree of the image structure.

Step c: In the case that the desired color density for the print image of the customer is not achieved, the toner concentration is manually or automatically changed until the actual color density coincides with the desired color density.

Step d: In comparison to the luminous power L1, the luminous power L2 for the toner marking is lowered given high color densities, meaning given dark image structures in the print image.

Step e: The basic setting of the print process is finished. Given subsequent printings of a plurality of pages, the toner concentration is controlled or regulated such that the color density present on the toner marking with the reduced luminous power L1 remains constant.

Figure 2:
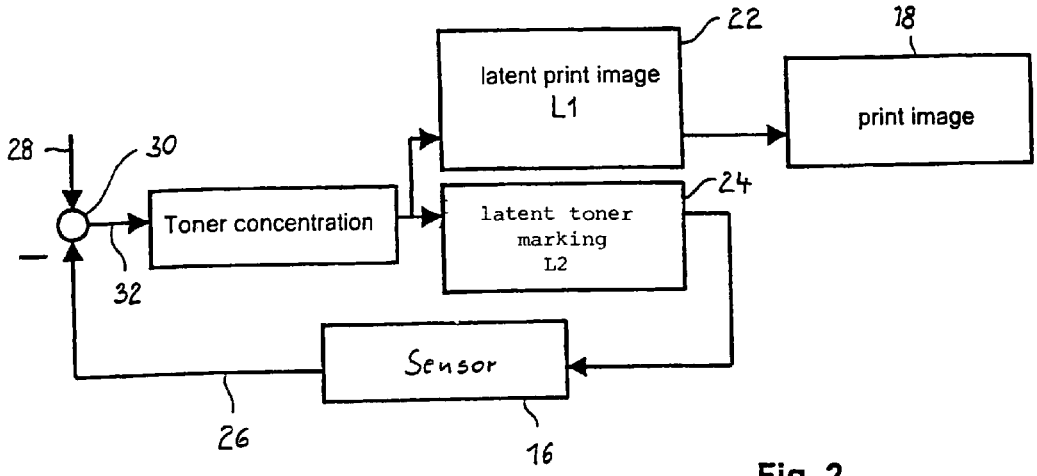
FIG. 2 shows a block diagram for regulation of the inking degree given a decrease of the luminous power for the toner marking.

FIG. 2 shows schematically in a block diagram the regulation of the inking given high color density of the print image for the client. The blocks 22 and 24 specify the generation of the latent print image 18 or of the latent toner marking 14. The light energy L2 of the LEDs to generate to latent toner marking is decreased by a constant factor in comparison with the light energy L1 for the generation of the latent print image 18. For example, this can occur by decreasing the power that is supplied to the corresponding LEDs of the LED comb. The inked toner marking is scanned with the aid of the reflection sensor 16 and forms the measured color density in a signal 26. This signal 26 represents an actual value of the print process. This actual value 26 is compared with a desired value 28. This desired value was previously established in a test operation in the measurement method according to step c, described further above. A desired value-actual value comparator 30 establishes the actual value deviation 32. Based on this deviation 32, the toner concentration is changed, for example increased or decreased. To adjust the toner concentration, for example, a conveying coil that effects the toner transport to the developer station can be acted upon. Given the toner concentration adjusted in such a manner, the print image 18 and the toner marking 14 are generated. The print image 18 is then output.

Figure 3:
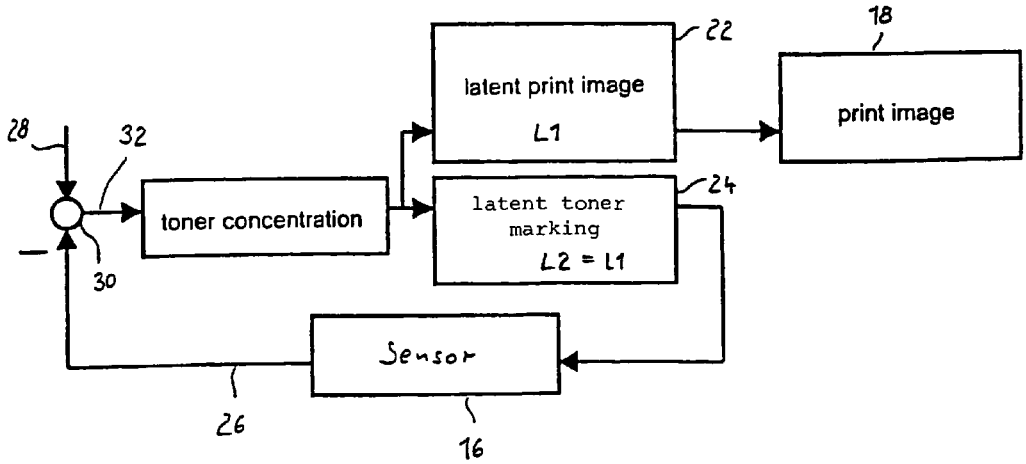
FIG. 3 illustrates the inking regulation given normal and lower ink density.

FIG. 3 shows the example given normal and low color density; identical parts are indicated identically. In the process of the generation of the latent print image 18 and the latent toner marking 14, the lowering of the energy for the generation of the toner marking 14 is cancelled, meaning the luminous power L2 is equal to the luminous power L1.

Figure 4:
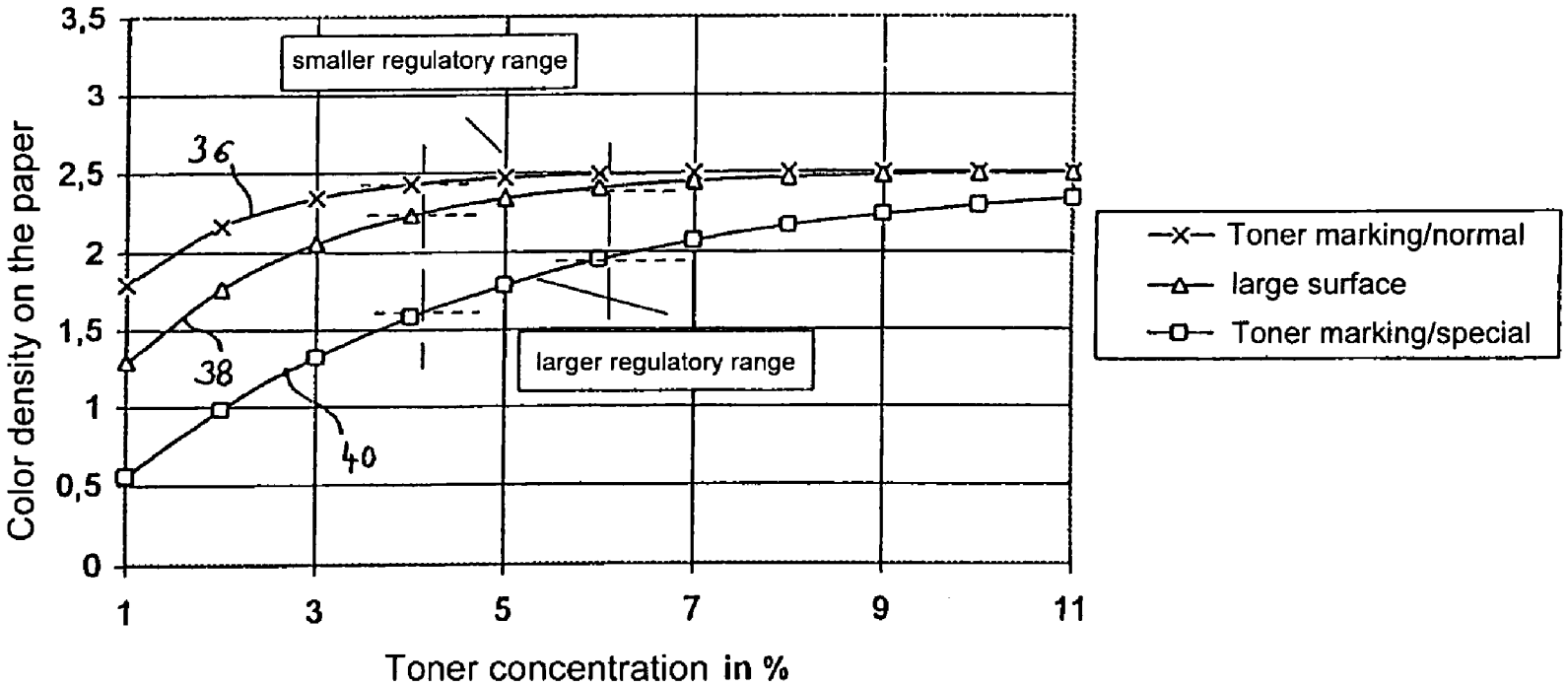
FIG. 4 is a diagram which shows the inking on the paper as a print image medium, dependent on the toner concentration.

FIG. 4 shows characteristic lines of the inking, dependent on the toner concentration in the developer station. The color density is applied in percent to the printed paper via the toner concentration. When the same light energy per area unit is used respectively for the latent toner marking 14 and the latent print image 18 with regard to otherwise identical image structures, the characteristic line 36 results. It is to be considered that the toner marking has a relatively small area in comparison to the print image 18. Accordingly, the inking is darker and the color density is increased. The characteristic line 38 results for a relatively large surface of the print image. The characteristic line 40 shows the connection of toner concentration and color density of the print image on the paper when the latent marking is generated with a lowered luminous power L2.

In the operating point with a toner concentration of 5%, it is to be recognized using the characteristic line that a relatively high color density is achieved on the paper. This characteristic line is, however, very flat, such that given a change of the toner concentration the color density on the paper barely changes any more, meaning a very small regulation range exists for the regulation process. By lowering the luminous power, a larger regulation range can be achieved given the same toner concentration, as the characteristic line 40 shows. The increase of the characteristic line or of the value of the differential of the color density on the paper to the toner concentration is magnified in this operating point at the characteristic line 40. In this manner, the regulatory precision for regulation of the print process is also improved. The luminous power L2 for the generation of the latent toner marking can be made ever smaller the higher the desired color density of the printed print image on the paper. The decrease of the luminous power L2 for the toner marking 14 can also occur such that the ratio or the differential quotient of toner concentration and color density at the operating point of the reflection sensor 16 exceeds a predetermined value.

As is to be recognized using FIG. 4, the characteristic lines 36, 38, 40 are not linear. In the region of smaller toner concentrations, a sufficient increase of the characteristic line 36 is present. This means that a decrease of the luminous power L2 for the toner marking 14 is no longer absolutely necessary, and can be cancelled. Therefore, in an exemplary embodiment of the invention, the decrease of the luminous power is cancelled at a color density value ≦ a predetermined threshold.

Numerous variations are possible. For example, the image carrier on which the toner marking 14 is applied can also be a photoconductor member. The system and method can also be applied for electromagnetic printing methods. It is also possible to transfer the toner marking 14 to a transfer member and to scan this toner mark 14 on the transfer member. Furthermore, for the generation of the latent marking, it is possible to adjust the toner concentration using predetermined characteristic lines that reproduce the connection between color density on the carrier material and the toner concentration given decreased energy.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim:

1. A method to control a print process in a printer or copier, comprising the steps of:

with a character generator generating a latent print image and a latent toner marking on an image carrier;

providing an optical reflection sensor to determine a color density of the toner marking after development;

decreasing an exposure energy per unit area for the generation of the latent toner marking in comparison to an energy per unit area for generation of the latent print image given an otherwise identical image structure, the decreasing of the energy occurring when at least one of a ratio or a differential quotient of toner concentration and color density at an operating point of the optical reflection sensor exceeds a predetermined value;

developing the latent print image and the latent toner marking with toner in a developer station;

with the optical reflection sensor determining color density of the developed toner marking; and adjusting toner concentration in the developer station dependent on a signal of the reflection sensor.

2. The method according to claim 1 wherein the toner concentration is adjusted in the developer station using a predetermined function of color density versus the toner concentration.

3. The method according to claim 1 wherein the toner concentration is adjusted in a measurement event such that a desired color density is present on the printed print image, and the signal of the optical reflection sensor is determined for the toner marking.

4. The method according to claim 3 wherein the toner concentration is adjusted in a regulation process such that the signal determined by the reflection sensor has a largely constant value for the toner marking.

5. The method according to claim 1 wherein the energy for the generation of the latent toner marking is made ever smaller a higher a desired color density of the printed print image.

6. The method according to claim 1 wherein for a color density value less than or equal to a predetermined threshold, the decrease of the energy for the toner marking is canceled.

7. The method according to claim 1 wherein a densitometer is used to establish the color density on the printed print image.

8. The method according to claim 1 wherein an electrophotographic print process is used as a print process for the printer or copier.

9. The method according to claim 8 wherein an LED character generator whose LEDS can be individually controlled is used as the character generator.

10. The method according to claim 1 wherein at least one of a photoconductor drum or a photoconductor member is used as the image carrier.

11. The method according to claim 1 wherein the toner marking is arranged outside of a region of the print image.

12. The method according to claim 1 wherein the toner marking developed on the image carrier is scanned by the optical reflection sensor.

13. The method according to claim 1 wherein the toner marking is scanned on a transfer member.

14. A device to control a print process in a printer or copier, comprising:

a character generator which generates a latent print image and a latent toner marking on an image carrier;

an optical reflection sensor which determines a color density of the toner marking after development;

a unit that decreases an energy per unit area for generation of the latent toner marking in comparison to an energy per unit area for generation of the latent print image, given an otherwise identical image structure, the decrease of the energy occurring when at least one of a ratio or a differential quotient of toner concentration and color density at an operating point of the reflection sensor exceeds a predetermined value;

a developer station which develops the latent print image and the latent toner marking with toner; and the developer station adjusting a toner concentration in the developer station dependent on a signal of the reflection sensor.

15. The device according to claim 14 wherein the toner concentration is adjusted in the developer station using a predetermined function of color density versus the toner concentration.

16. The device according to claim 14 wherein the toner concentration is adjusted in a measurement event such that a desired color density is present on a printed print image, and the signal of the optical reflection sensor is determined for the toner marking.

17. The device according to claim 16 wherein the toner concentration is adjusted in a regulation process such that the signal determined by the reflection sensor has a largely constant value for the toner marking.

18. The device according to claim 14 wherein a decrease of the energy for the generation of the latent image marking is made ever smaller a higher a desired color density of the printed print image.

19. The device according to claim 14 wherein for a color density value less than or equal to a predetermined threshold, the decrease of the energy for the toner marking is cancelled.

20. The device according to claim 14 wherein an electrophotographic print process is used as a print process for the printer or copier.

21. The device according to claim 20 wherein an LED character generator whose LEDS can be individually controlled is used as the character generator.

22. The device according to claim 14 wherein one of a photoconductor drum or a photoconductor member is used as the image carrier.

23. The device according to claim 14 wherein the toner marking is arranged outside of a region of the print image.

24. The device according to claim 14 wherein the latent toner marking developed on the image carrier is scanned by the optical reflection sensor.

25. The device according to claim 14 wherein the toner marking is scanned on a transfer member.

26. A method to control a print process in a printer or copier, comprising the steps of:

with a character generator generating a latent print image and a latent toner marking on an image carrier;

providing an optical reflection sensor to determine a color density of the toner marking after development;

decreasing an exposure energy per unit area for the generation of the latent toner marking in comparison to an energy per unit area for generation of the latent print image, the decreasing of the energy occurring when at least one of a ratio or a differential quotient of toner concentration and color density at an operating point of the optical reflection sensor exceeds a predetermined value;

developing the latent print image and the latent toner marking with toner in a developer station;

with the optical sensor determining color density of the developed toner marking; and adjusting the toner concentration in the developer station dependent on a signal of the optical sensor.

27. A device to control a print process in a printer or copier, comprising:

a character generator which generates a latent print image and a latent toner marking on an image carrier;

an optical reflection sensor which determines a color density of the toner marking after development;

a unit that decreases an energy per unit area for generation of the latent toner marking in comparison to an energy per unit area for generation of the latent print image, the decrease of the energy occurring when at least one of a ratio or a differential quotient of toner concentration and color density at an operating point of the reflection sensor exceeds a predetermined value;

a developer station which develops the latent print image and the latent toner marking with toner; and the developer station adjusting the toner concentration in the developer station dependent on a signal of the optical sensor.

* * * * *